US006793017B2

(12) United States Patent
Nguyen et al.

(10) Patent No.: US 6,793,017 B2
(45) Date of Patent: Sep. 21, 2004

(54) METHOD AND APPARATUS FOR TRANSFERRING MATERIAL IN A WELLBORE

(75) Inventors: Philip D. Nguyen, Duncan, OK (US); Ronald J. Crook, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 90 days.

(21) Appl. No.: 10/205,093

(22) Filed: Jul. 24, 2002

(65) Prior Publication Data

US 2004/0016546 A1 Jan. 29, 2004

(51) Int. Cl.[7] ..... E21B 43/04; E21B 43/00; E21B 33/14

(52) U.S. Cl. ..... 166/278; 166/51; 166/177.4; 166/289; 405/129.35

(58) Field of Search ..... 166/278, 285, 166/284, 288, 292, 313, 381, 386, 387, 51, 55, 177.1, 242.1, 242.3, 242.9; 405/129.35

(56) References Cited

U.S. PATENT DOCUMENTS

| | | | | |
|---|---|---|---|---|
| 2,135,909 A | | 11/1938 | Monson | 166/21 |
| 2,187,895 A | | 1/1940 | Sanders | 166/21 |
| 2,190,989 A | | 2/1940 | Johnston | 166/21 |
| 2,193,808 A | | 3/1940 | Dieterich | 166/21 |
| 2,288,557 A | | 6/1942 | Vollmer | 166/26 |
| 2,342,913 A | | 2/1944 | Williams et al. | 166/5 |
| 2,344,909 A | | 3/1944 | Williams et al. | 166/5 |
| 3,044,547 A | | 7/1962 | Jarboe et al. | 166/12 |
| 3,119,448 A | | 1/1964 | Rhoades | 166/12 |
| 3,216,497 A | * | 11/1965 | Howard et al. | 166/278 |
| 3,368,623 A | | 2/1968 | Carter et al. | 166/12 |
| 3,605,899 A | | 9/1971 | Tate et al. | 166/300 |
| 3,816,151 A | | 6/1974 | Podlas | 106/194 |
| 3,862,663 A | | 1/1975 | Curtice et al. | 166/276 |
| 4,018,283 A | * | 4/1977 | Watkins | 166/278 |
| 4,042,032 A | | 8/1977 | Anderson et al. | 166/276 |
| 4,070,865 A | | 1/1978 | McLaughlin | 61/36 |
| 4,074,760 A | | 2/1978 | Copeland et al. | 166/276 |
| 4,336,842 A | | 6/1982 | Graham et al. | 166/276 |
| 4,829,100 A | | 5/1989 | Murphey et al. | 523/131 |

(List continued on next page.)

FOREIGN PATENT DOCUMENTS

| | | | |
|---|---|---|---|
| WO | WO 01/14691 A1 | 3/2000 | E21B/43/08 |
| WO | WO 00/061913 | 10/2000 | E21B/43/04 |
| WO | WO 01/44619 A1 | 6/2001 | E21B/43/04 |

OTHER PUBLICATIONS

SPE 30096 entitled "Factors Affecting Proppant Flowback with Resin Coated Proppants" by S.W. Almond et al. dated 1995.

SPE 23741 entitled "Mechanical Fluid Loss Control System Used During Sand Control Operations" by H.L. Restarick dated 1992.

(List continued on next page.)

*Primary Examiner*—David Bagnell
*Assistant Examiner*—Jennifer Gay
(74) *Attorney, Agent, or Firm*—Craig W. Roddy; Haynes & Boone, LLP

(57) ABSTRACT

In a method and apparatus for transferring material in a wellbore in an earth formation, a pipe is inserted into the wellbore. A conduit is inserted alongside the pipe into the wellbore. The conduit is fixed to the pipe and has a first section with a perforated wall located adjacent a non-production interval of the formation, and has a second section with an unperforated wall located adjacent a production interval of the formation. The material is injected into the conduit and out the perforated wall of the first section of the conduit.

55 Claims, 5 Drawing Sheets

U.S. PATENT DOCUMENTS

| | | | | | |
|---|---|---|---|---|---|
| 4,945,991 | A | | 8/1990 | Jones | 166/278 |
| 5,062,484 | A | | 11/1991 | Schroeder, Jr. et al. | 166/278 |
| 5,082,052 | A | | 1/1992 | Jones et al. | 166/51 |
| 5,113,935 | A | | 5/1992 | Jones et al. | 166/51 |
| 5,128,390 | A | | 7/1992 | Murphey et al. | 523/130 |
| 5,161,613 | A | | 11/1992 | Jones | 166/242 |
| 5,161,618 | A | | 11/1992 | Jones et al. | 166/308 |
| 5,333,688 | A | | 8/1994 | Jones et al. | 166/278 |
| 5,339,902 | A | | 8/1994 | Harris et al. | 166/293 |
| 5,355,956 | A | | 10/1994 | Restarick | 166/296 |
| 5,363,916 | A | | 11/1994 | Himes et al. | 166/276 |
| 5,381,864 | A | | 1/1995 | Nguyen et al. | 166/280 |
| 5,390,966 | A | | 2/1995 | Cox et al. | 285/137.1 |
| 5,393,810 | A | | 2/1995 | Harris et al. | 524/56 |
| 5,419,394 | A | | 5/1995 | Jones | 166/51 |
| 5,435,391 | A | * | 7/1995 | Jones | 166/308 |
| 5,443,117 | A | | 8/1995 | Ross | 166/51 |
| 5,515,915 | A | | 5/1996 | Jones et al. | 166/51 |
| 5,529,123 | A | | 6/1996 | Carpenter et al. | 166/293 |
| 5,588,487 | A | | 12/1996 | Bryant | 166/51 |
| 5,595,246 | A | * | 1/1997 | Voll et al. | 166/278 |
| 5,609,207 | A | | 3/1997 | Dewprashad et al. | 166/276 |
| 5,636,691 | A | | 6/1997 | Hendrickson et al. | 166/278 |
| 5,697,441 | A | | 12/1997 | Vercaemer et al. | 166/285 |
| 5,746,274 | A | * | 5/1998 | Voll et al. | 166/278 |
| 5,755,286 | A | | 5/1998 | Ebinger | 166/281 |
| 5,839,510 | A | | 11/1998 | Weaver et al. | 166/276 |
| 5,842,516 | A | | 12/1998 | Jones | 166/56 |
| 5,848,645 | A | | 12/1998 | Jones | 166/280 |
| 5,868,200 | A | | 2/1999 | Bryant et al. | 166/51 |
| 5,890,533 | A | | 4/1999 | Jones | 166/51 |
| 5,921,317 | A | | 7/1999 | Dewprashad et al. | 166/208 |
| 5,921,318 | A | | 7/1999 | Ross | 166/250.17 |
| 5,924,488 | A | | 7/1999 | Nguyen et al. | 166/280 |
| 5,934,376 | A | | 8/1999 | Nguyen et al. | 166/278 |
| 5,960,880 | A | | 10/1999 | Nguyen et al. | 166/280 |
| 6,003,600 | A | | 12/1999 | Nguyen et al. | 166/281 |
| 6,016,870 | A | | 1/2000 | Dewprashad et al. | 166/295 |
| 6,047,773 | A | | 4/2000 | Zeltmann et al. | 166/281 |
| 6,050,336 | A | | 4/2000 | Willauer et al. | 166/286 |
| 6,059,032 | A | | 5/2000 | Jones | 166/278 |
| 6,063,738 | A | | 5/2000 | Chatterji et al. | 507/269 |
| 6,070,663 | A | | 6/2000 | Cernocky et al. | 166/272.3 |
| 6,116,343 | A | | 9/2000 | Van Petegem et al. | 166/297 |
| 6,125,933 | A | | 10/2000 | Ross | 166/250.01 |
| 6,202,751 | B1 | | 3/2001 | Chatterji et al. | 166/276 |
| 6,220,345 | B1 | | 4/2001 | Jones et al. | 166/51 |
| 6,227,303 | B1 | | 5/2001 | Jones | 166/378 |
| 6,230,803 | B1 | | 5/2001 | Morton et al. | 166/278 |
| 6,286,600 | B1 | | 9/2001 | Hall et al. | 16/305.1 |
| 6,298,916 | B1 | * | 10/2001 | Tibbles et al. | 166/278 |
| 6,302,216 | B1 | | 10/2001 | Patel | 166/375 |
| 6,311,773 | B1 | | 11/2001 | Todd et al. | 166/280 |
| 6,318,469 | B1 | | 11/2001 | Patel | 166/305.1 |
| 6,354,378 | B1 | | 3/2002 | Patel | 166/374 |
| 6,516,881 | B2 | * | 2/2003 | Hailey, Jr. | 166/278 |
| 6,581,689 | B2 | * | 6/2003 | Hailey, Jr. | 166/278 |
| 6,588,506 | B2 | * | 7/2003 | Jones | 166/278 |
| 6,588,507 | B2 | * | 7/2003 | Dusterhoft et al. | 166/278 |
| 6,601,646 | B2 | * | 8/2003 | Streich et al. | 166/278 |
| 6,644,406 | B1 | * | 11/2003 | Jones | 166/235 |
| 2002/0125007 | A1 | * | 9/2002 | McGregor et al. | 166/278 |
| 2002/0189808 | A1 | * | 12/2002 | Nguyen et al. | 166/278 |
| 2002/0189809 | A1 | * | 12/2002 | Nguyen et al. | 166/278 |
| 2003/0000699 | A1 | * | 1/2003 | Hailey, Jr. | 166/278 |
| 2003/0000700 | A1 | * | 1/2003 | Hailey, Jr. | 166/278 |
| 2003/0141060 | A1 | * | 7/2003 | Hailey et al. | 166/278 |
| 2003/0141061 | A1 | * | 7/2003 | Hailey et al. | 166/278 |
| 2003/0183386 | A1 | * | 10/2003 | McGregor et al. | 166/278 |
| 2003/0188871 | A1 | * | 10/2003 | Dusterhoft et al. | 166/308 |
| 2003/0221829 | A1 | * | 12/2003 | Patel et al. | 166/278 |

OTHER PUBLICATIONS

Article entitled "Frac Pac Technology Still Evolving", Oil & Gas Journal, Oct. 23, 1995, pp. 60–70.

SPE 68205 entitled "Simultaneous Gravel Packing And Filter Cake Removal In Horizontal Wells Applying Shunt Tubes And Novel Carrier and Breaker Fluid" by Pedro M. Saldungaray et al. dated 2001.

SPE 58775 entitled "Screenless Single Trip Multizone Sand Control Tool System Saved Rig Time" by Travis Hailey et al. dated 2000.

Halliburton Brochure entitled Sand Control Screens Quality, Innovation, Reliability dated 1994.

Halliburton brochure entitled "Caps$^{SM}$ Sand Control Service For Horizontal Completions Improves Gravel Pack Reliability And Increases Production Potential From Horizontal Completions" dated 2000.

Halliburton brochure entitled "CAPS$^{SM}$ Concentric Annular Packing Service For Sand Control Helps Insure Successful Horizontal Completions In Unconsolidated Sand" dated 1999.

SPE/Petroleum Society of CIM 65464 entitled "Application of Hydraulic Fractures In Openhole Horizontal Wells" by P.D. Ellis et al. dated 2000.

* cited by examiner 36
36
54
54
34d
34d
48d
48d
52
52
34a
34a
48a
48a
36
36
44
44
34b
34b
48b
48b
46
46
36
36
34c
34c
48c
48c
56
56
34e
34e
48e
48e
58
58
48f
48f
36
36
34f 36
36
54
54
34d
34d
48d
48d
52
52
34a
34a
48a
48a
36
36
44
44
34b
34b
48b
48b
46
46
36
36
34c
34c
48c
48c
56
56
34e
34e
48e
48e
58
58
48f
48f
36
36
34f

METHOD AND APPARATUS FOR TRANSFERRING MATERIAL IN A WELLBORE

CROSS-REFERENCE TO RELATED APPLICATIONS

This application relates to co-pending U.S. patent applications (a) Ser. No. 10/053,054, entitled METHOD OF FORMING PERMEABLE SAND SCREENS IN WELLBORES, naming Philip D. Nguyen, Henry L. Restarick, and Ronald G. Dusterhoft as inventors, (b) Ser. No. 09/882,572, entitled IMPROVED METHODS AND APPARATUS FOR GRAVEL PACKING OR FRAC PACKING WELLS, naming Philip D. Nguyen, Michael W. Sanders, Ronald G. Dusterhoft, Henry L. Restarick, and David E. McMechan as inventors, (c) Ser. No. 09/927,217, entitled APPARATUS AND METHOD FOR GRAVEL PACKING AN INTERVAL OF A WELLBORE, naming Ronald W. McGregor, Travis T. Hailey, Jr., William D. Henderson, Robert L. Crow, and Philip D. Nguyen as inventors, and (d) Ser. No. 09/800,199, entitled APPARATUS AND METHOD FOR GRAVEL PACKING AN INTERVAL OF A WELLBORE, naming Travis T. Hailey, Jr., William D. Henderson, Stephen L. Crow, and Philip D. Nguyen as inventors. Each of these co-pending applications is incorporated herein by reference in its entirety, and is assigned to the assignee of this application.

BACKGROUND

The disclosures herein relate generally to wellbores and in particular to a method and apparatus for transferring material in a wellbore. Often, there is a need for transferring material such as conformance agents, cement and gravel slurries, etc., in a wellbore. However, previous techniques for transferring material in a wellbore have various shortcomings. Thus, a need has arisen for a method and apparatus for transferring material in a wellbore, in which various shortcomings of previous techniques are overcome.

DETAILED DESCRIPTION

Figure 1:
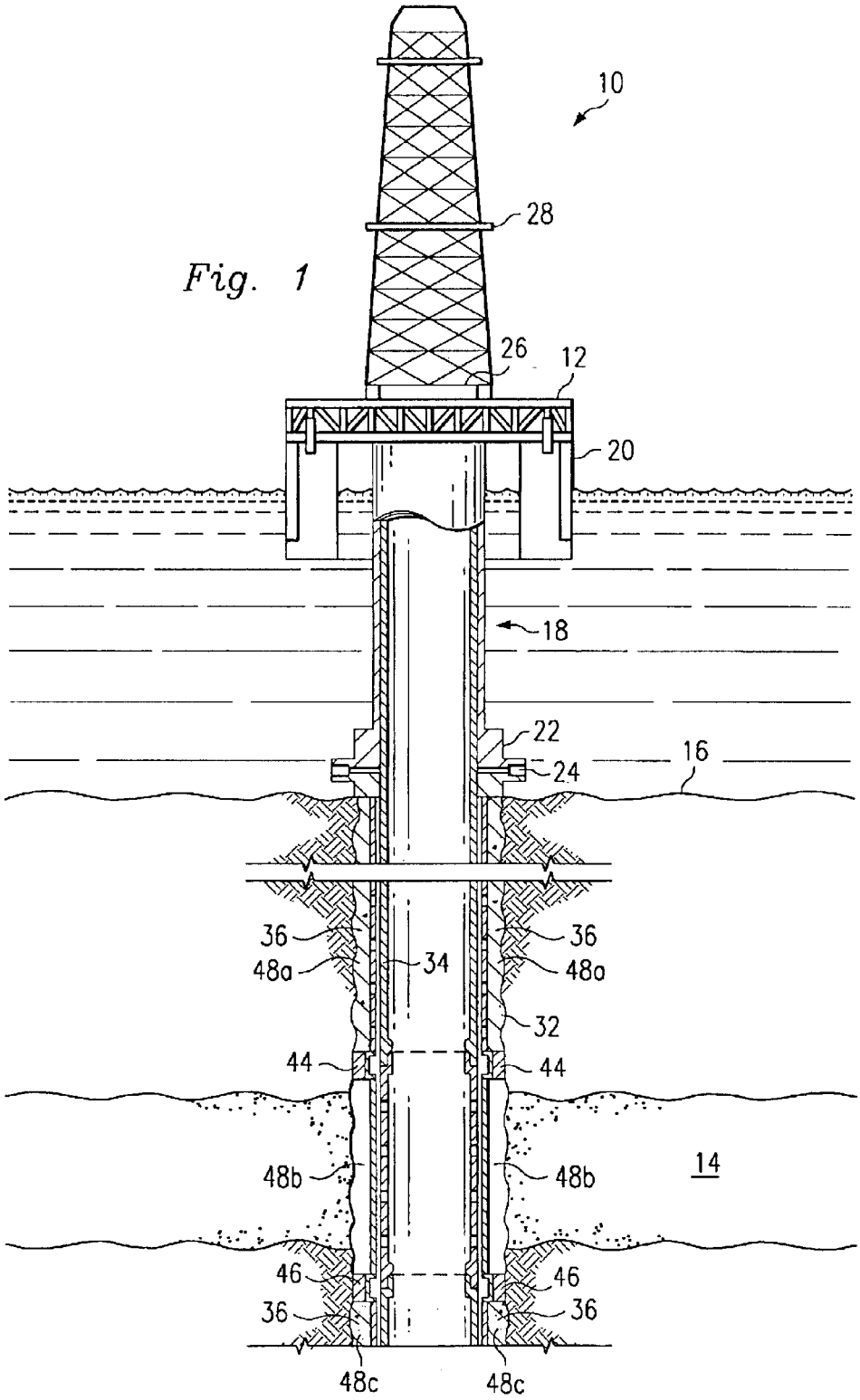
FIG. 1 is a partial elevational/partial sectional view of apparatus for transferring material in a wellbore.

FIG. 1 shows apparatus, indicated generally at 10, for transferring material from a surface-located offshore oil and gas platform 12. The platform 12 is semi-submersible and is centered over a submerged oil and gas formation 14 located below a sea floor 16. A subsea conduit 18 extends from a deck 20 of the platform 12 to a wellhead installation 22 that includes blowout preventers 24. The platform 12 has a hoisting apparatus 26 and a derrick 28 for raising and lowering pipe strings such as a work string, or the like.

A wellbore 32 is formed through the various earth strata including the formation 14. As discussed further below, a pipe, or casing, 34 is insertable into the wellbore 32 and is cemented within the wellbore 32 by cement 36. A centralizer/packer device 44 is located in the annulus between the wellbore 32 and the casing 34 just above the formation 14, and a centralizer/packer device 46 is located in the annulus between the wellbore 32 and the casing 34 just below the formation 14. The devices 44 and 46 are discussed in greater detail below.

Figure 2:
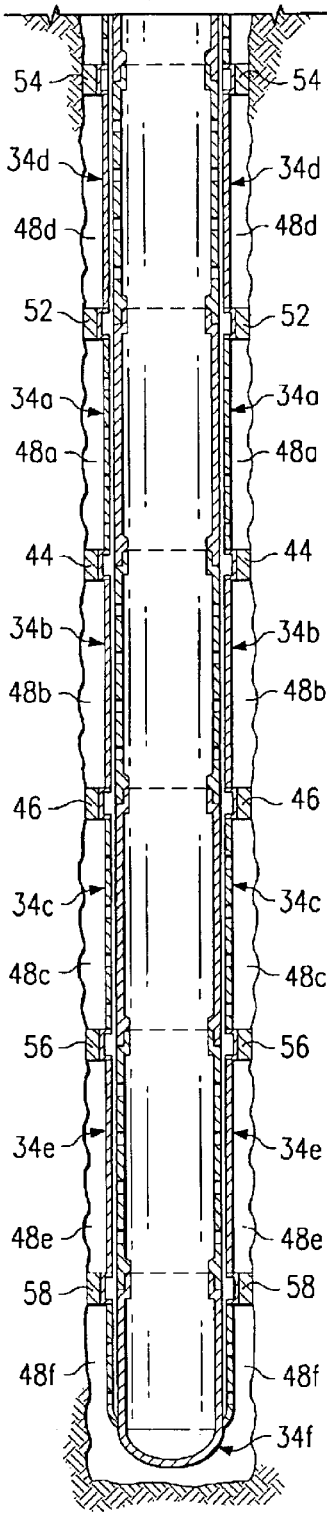
FIG. 2 is a sectional view of a portion of the apparatus of FIG. 1.

An annulus 48*a* is defined between the wellbore 32 and the casing 34 just above the device 44, an annulus 48*b* is defined between the wellbore 32 and the casing 34 between the devices 44 and 46, and an annulus 48*c* is defined between the wellbore 32 and the casing 34 just below the device 46. As better shown in FIG. 2, an annulus 48*d* is formed above and contiguous with the annulus 48*a*, an annulus 48*e* is formed below and contiguous with the annulus 48*c*, and an annulus 48*f* is formed below and contiguous with the annulus 48*e*. The apparatus 10 selectively transfers material into the annuluses 48*a*, 48*b*, 48*c*, 48*d*, 48*e*, and 48*f* in a manner to be described.

The casing 34 is formed by six separate, individual sections 34*a*, 34*b*, 34*c*, 34*d*, 34*e*, and 34*f* located adjacent the annuluses 48*a*, 48*b* 48*c*, 48*d*, 48*e*, and 48*f*, respectively. The casing sections 34*a*, 34*b*, 34*c*, 34*d*, 34*e*, and 34*f* are connected at their corresponding ends, in a manner to be described. It is understood that each of the casing sections 34*b*, 34*d*, and 34*e*, and their corresponding annuluses 48*b*, 48*d* and 48*e*, are located adjacent a respective production interval of the formation 14 as shown in connection with the annulus 48*b* in FIG. 1; and that the casing sections 34*a*, 34*c*, and 34*f*, and their corresponding annuluses 48*a*, 48*c*, and 48*f*, are located adjacent non-production intervals of the formation 14.

Each of the casing sections 34*b*, 34*d*, and 34*e* have a series of axially and angularly spaced perforations extending therethrough. These perforations are normally closed by blockages, such as a conventional removable sealant (e.g. magnesium oxide/magnesium chloride/calcium carbonate mixture, wax, oil soluble resin, soluble polymer, ceramic, or a mixture thereof), and subsequently are opened by removing the blockages from the perforations, under conditions to be described. This removal can be effected by applying heat to the casing 34, by applying frequency waves to the casing, by injecting a dissolving fluid (e.g. acid, oil) into the casing, or by another suitable technique. The casing sections 34*a*, 34*c*, and 34*f*, are not perforated for reasons to be described.

The device 44 functions to substantially centralize the casing sections 34*a* and 34*b* within the wellbore 32, and to substantially isolate material in the annulus 48*a* from reaching the annulus 48*b*, and vice versa. Likewise, the device 46 substantially centralizes the casing sections 34*b* and 34*c* within the wellbore 32, and substantially isolates material in the annulus 48*b* from the annulus 48*c*, and vice versa. A device 52 is located in the annulus between the wellbore 32 and the casing 34 above, and in an axially-spaced relation to, the device 44. The device 52 substantially centralizes the casing sections 34*a* and 34*d* of the casing 34 within the wellbore 32, and substantially isolates material in the annulus 48*a* from the annulus 48*d*, and vice versa. A device 54 is located in the annulus between the wellbore 32 and the casing 34 above, and in an axially-spaced relation to, the device 52. The device 54 substantially centralizes the casing section 34*d* of the casing 34, as well as that portion of the casing (not shown in FIG. 2) extending above the device 54, within the wellbore 32, and substantially isolates material in the annulus 48*d* from the annulus (not shown in FIG. 2) extending above the device 54.

A device 56 is located in the annulus between the wellbore 32 and the casing 34 below, and in an axially-spaced relation to, the device 46. The device 56 substantially centralizes the casing sections 34*c* and 34*e* of the casing 34 within the wellbore 32, and substantially isolates material in the annulus 48*c* from the annulus 48*e*, and vice versa. A device 58 is located in the annulus between the wellbore 32 and the casing 34 below, and in an axially-spaced relation to, the device 56. The device 58 substantially centralizes the casing sections 34*e* and 34*f* of the casing 34 within the wellbore 32, and substantially isolates material in the annulus 48*e* from the annulus 48*f*, and vice versa. Since the devices 44, 46, 52, 54, 56, and 58 are conventional, they will not be described in detail.

Figure 3:
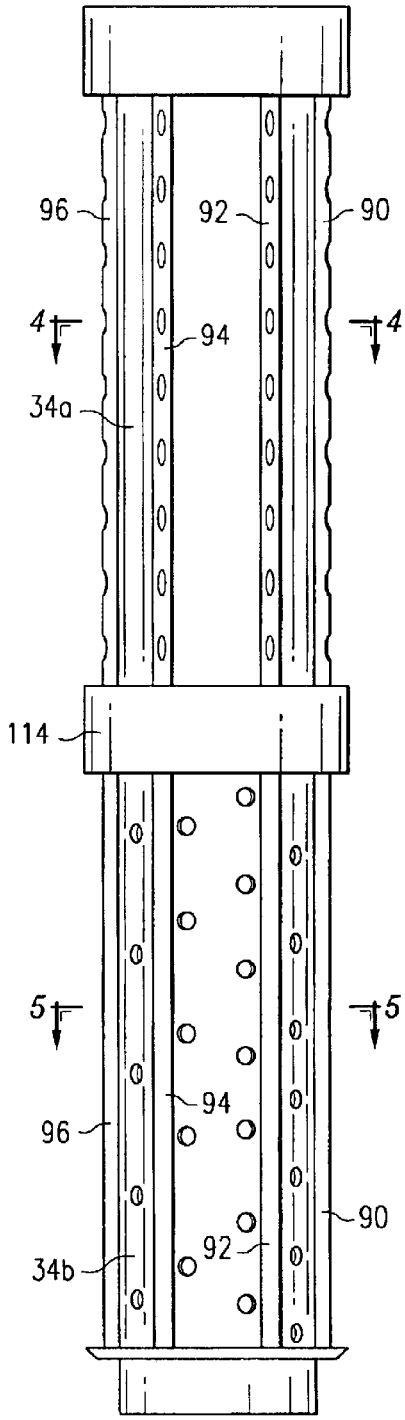
FIG. 3 is an elevational view of a portion of the apparatus of FIG. 2.
Figure 4:
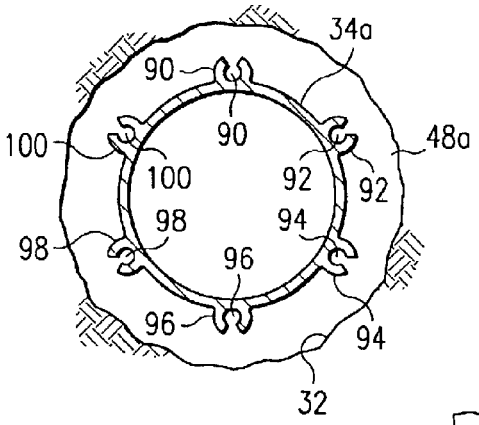
FIG. 4 is a sectional view of a first portion of the apparatus of FIG. 3, taken along the line 4—4 of FIG. 3.
Figure 5:
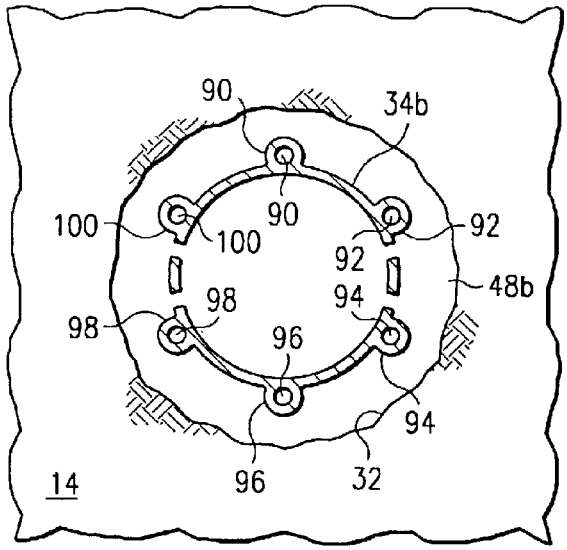
FIG. 5 is a sectional view of a second portion of the apparatus of FIG. 3, taken along the line 5—5 of FIG. 3.

As shown in FIGS. 3-5, six axially-extending conduits 90, 92, 94, 96, 98 and 100 are fixed to, and are angularly spaced around, the casing 34 and, as such, are insertable alongside the casing 34 into the wellbore 32. The conduits 90, 92, 94, 96, 98 and 100 have diameters substantially less that that of the casing 34, and are fixed to the casing 34 by being either integral with the casing 34 or connected to an outer wall of the casing 34 (e.g. via welding). The conduits 90, 92, 94, 96, 98 and 100 span the entire length of the casing sections 34*a*, 34*b*, 34*c*, 34*d*, 34*e*, and 34*f*, and the remaining portions of the conduits extend up the remaining length of the casing 34 and the wellbore 32 to the platform 12. As shown in FIGS. 3–5 in connection with the casing sections 34*a* and 34*b*, a series of axially-spaced perforations extend through the outer arcuate portions of those portions of the conduits 90, 92, 94, 96, 98, and 100 extending adjacent the casing sections 34*a*, 34*c* and 34*f*, while the portions of the conduits extending adjacent the casing sections 34*b*, 34*d*, and 34*e* are not perforated.

Figure 6:
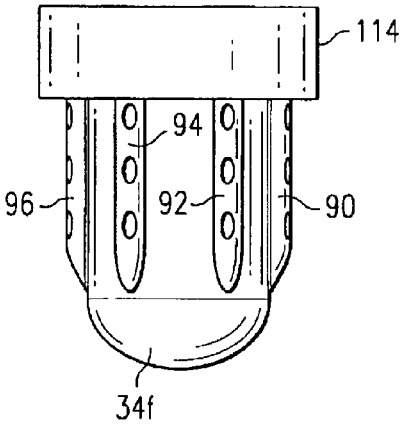
FIG. 6 is an elevational view of a portion of the apparatus of FIG. 2.

Referring to FIG. 6, the casing section 34*f* has a closed lower end, and the lower end portions of the conduits 90, 92, 94, and 96, are bent radially inwardly so as to register with corresponding openings formed through the lower end portion of the casing section 34*f*, to communicate the casing 34 with the conduits for reasons to be described. Although not shown in FIG. 6, it is understood that the conduits 98 and 100 are bent and register with the casing section 34*f* in the same manner.

Figure 7:
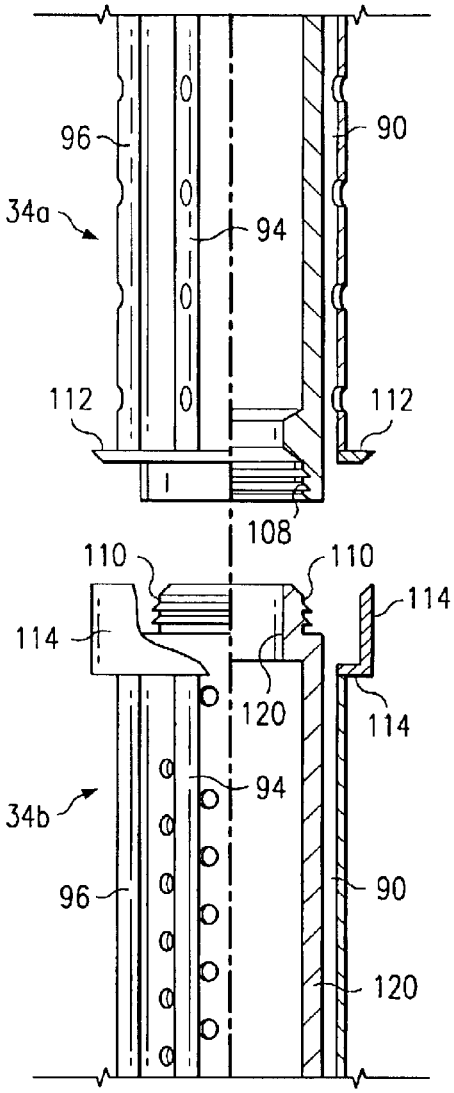
FIG. 7 is a partial elevational/partial sectional view of the apparatus of FIG. 3 in a disconnected position.
Figure 8:
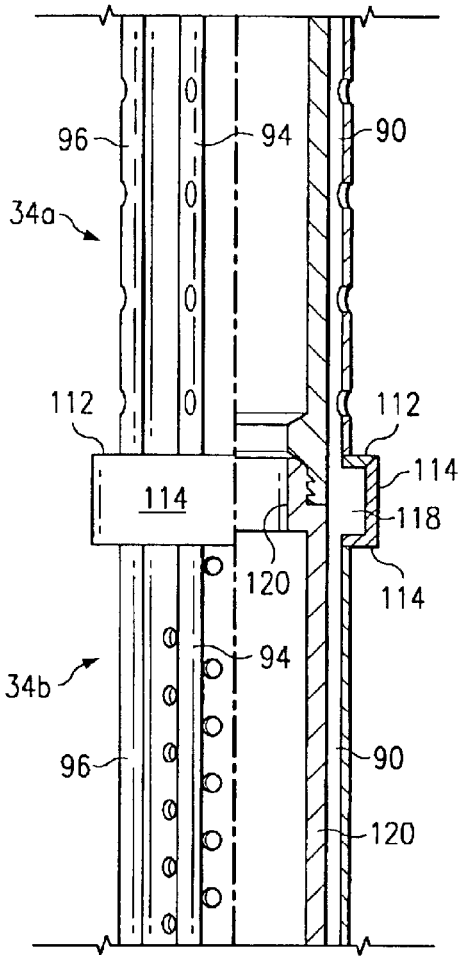
FIG. 8 is a partial elevational/partial sectional view of the apparatus of FIG. 3 in a connected position.

The adjacent casing sections 34*a* and 34*b* are connected, at their corresponding ends in a manner depicted in FIGS. 7 and 8. In particular, the casing section 34*a* includes an internally threaded coupling 108, and the casing section 34*b* includes an externally threaded coupling 110. Accordingly, as shown in FIG. 8, the coupling 110 is screwed into the coupling 108 to connect the casing sections 34*a* and 34*b*. In this connected position, a flange 112 of the casing section 34*a* connects to a shroud 114 (FIGS. 7 and 8) of the casing section 34*b* in any conventional manner. After such connection, the flange 112, the shroud 114, and the corresponding outer surfaces of the couplings 108 and 110 together define a space 118 (FIG. 8). The space 118 is positioned between (and fluidly connects) the sections of the conduits 90, 92, 94, 96, 98 and 100 extending adjacent the casing sections 34*a* and 34*b*, and thus operates as a mixer for re-mixing a slurry as it flows through the conduits in a manner to be described. It is noted that, although the casing section 34*b* is perforated for a great majority of its length, its upper end portion extending adjacent the shroud 114 is not perforated, so that the interior 120 of the casing section 34*b* is substantially isolated from the space 118.

It is understood that the other end portions of the casing sections 34*a* and 34*b* are connected to the corresponding end portions of the casing sections 34*d* and 34*c*, respectively, and that the section 34*e* is connected to the sections 34*c* and 34*f*, in an identical manner.

Figure 9:
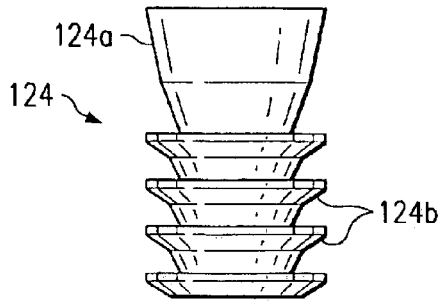
FIG. 9 is an elevational view of a plug utilized in the apparatus of FIG. 1.

A plug 124 is shown in FIG. 9 and comprises a substantially cylindrical body member 124*a* having a plurality of axially-spaced wipers 124*b* extending from the body member. The plug 124 is conventional, and its function will be described in detail.

In operation, a first material, such as a conformance agent or cement slurry, is introduced into the upper end of the casing 34 at the platform 12 by pumping, or the like. During this mode, the perforations in the casing sections 34*b*, 34*d*, and 34*e* remain blocked in the manner discussed above so that the material passes downwardly for the full length of the casing. The plug 124 is then inserted into the upper end of the casing 34 and is pushed, in a conventional manner, through the casing 34 to force substantially all of the material out the above mentioned openings in the casing section 34*f* and into the bent end portions of the conduits 90, 92, 94, 96, 98 and 100 for flow upwardly through the conduits. In addition, or alternatively, the material can be injected directly into the upper end portions of the conduits 90, 92, 94, 96, 98 and 100 directly from the platform 12.

Figure 10:
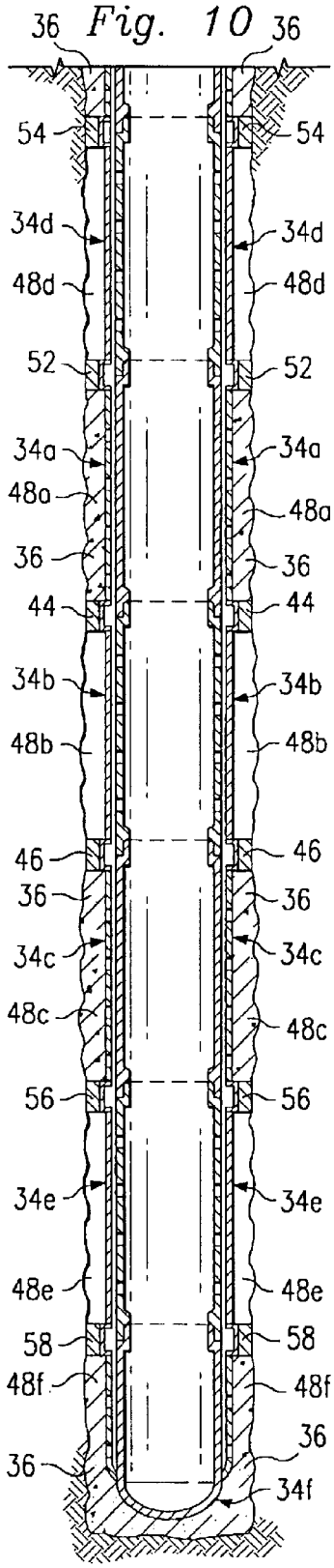
FIG. 10 is a sectional view of the apparatus of FIG. 2 after a first operation.
Figure 11:
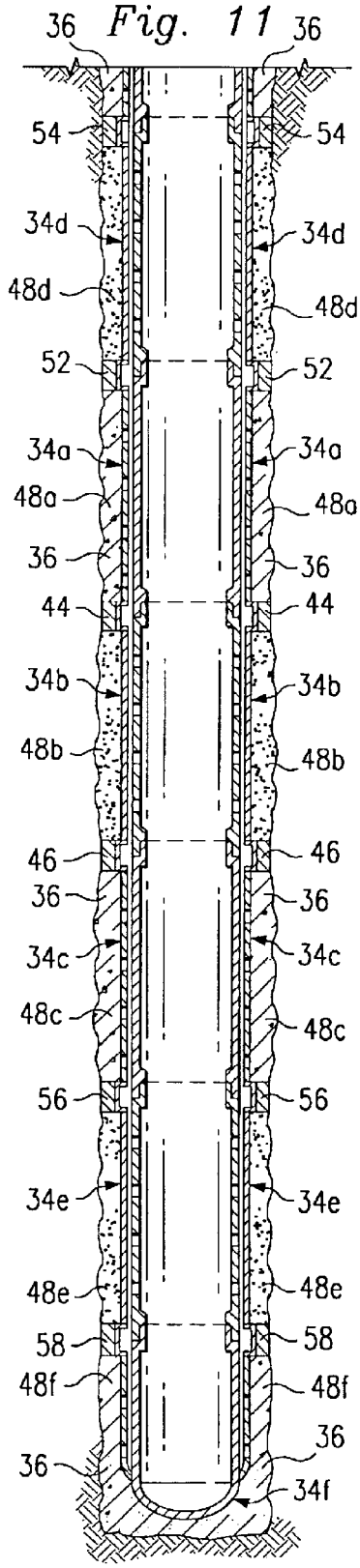
FIG. 11 is a sectional view of the apparatus of FIGS. 2 and 10 after a second operation.

The material flowing through the conduits 90, 92, 94, 96, 98 and 100 flows out the perforations in those portions of the conduits extending adjacent the non-perforated casing sections 34*a*, 34*c*, and 34*f* to substantially fill the corresponding annuluses 48*a*, 48*c*, and 48*f*, respectively with the material, as shown in FIG. 10. The devices 44 and 52 substantially isolate the material in the annulus 48*a* from the annuluses 48*b* and 48*d*, respectively; the devices 46 and 56 substantially isolate the material in the annulus 48*c* from the annulus 48*b* and 48*e*, respectively; and the device 58 substantially isolates the material in the annulus 48*f* from the annulus 48*e*. Those portions of the conduits 90, 92, 94, 96, 98, and 100 having nonperforated walls do not release the material into any annulus, but rather, transfer the injected first material to their respective adjacent perforated conduit portions for discharge in the above manner. Thus, the casing 34 is cemented to the wellbore 32 through the annuluses 48*a*, 48*c* and 48*f* adjacent non-production intervals of the formation, as shown by the cement 36 in the annuluses 48*a*, 48*c* and 48*f* in FIGS. 1, 10 and 11.

After the cementing step is completed in the manner described above, the perforations in the casing sections 34*b*, 34*d*, and 34*e* are opened by removing their blockages in the manner discussed above, and a second material, such as a fluid gravel slurry that includes a liquid carrier and a particulate material such as gravel (hereinafter referred to as "slurry"), is injected from the platform 12 into the casing by pumping, or the like. As better shown in FIG. 11, the slurry flows out the opened perforations of the casing sections 34*b*, 34*d* and 34*e* and substantially fills the annuluses 48*b*, 48*d*, and 48*e*. That portion of the slurry passing into the non-perforated casing sections 34*a*, 34*c* and 34*f* is transferred to their corresponding adjacent perforated sections 34*b*, 34*d*, and 34*e* for discharge in the above manner; while the devices 44, 46, 52, 54, 56 and 58 isolate the adjacent annuluses 48*a*, 48*b*, 48*c*, 48*d*, 48*e* and 48*f* in the manner described above.

Preferably, the slurry's particulate material is coated with curable resin (either pre-coated or coated on-the-fly), so that a hardenable permeable gravel pack mass is formed as a filter in the annuluses 48*b*, 48*d*, and 48*e*. The gravel packs thus formed in the annuluses 48*b*, 48*d*, and 48*e* are highly permeable to the flow of hydrocarbon fluids yet substantially block the flow of particulate material from the hydrocarbon fluids and into the wellhead installation 22 (FIG. 1). Thus, relatively clean slurry can flow from the annuluses 48*b*, 48*d*, and 48*e* into the different production areas of the productions intervals of the formation 14 and/or return to the platform 12.

Although illustrative embodiments have been shown and described, a wide range of modification, change and substitution is contemplated in the foregoing disclosure and, in some instances, some features of the embodiments may be employed without a corresponding use of other features. For example, although the materials injected into the casing 34 and therefore into the annuluses 48*a*, 48*b*, 48*c*, 48*d*, 48*e* and 48*f* are described generally above, it is understood that the materials can be varied and/or supplemented within the scope of the inventions. For example, a pre-treating material, in the form of a conventional conformance agent, can initially be injected in the casing 34 in the manner discussed above to protect against invasion of water or gas during subsequent production of hydrocarbon materials through the wellbore 32. Then, after such pre-treating, the cement slurry or alternative bonding agent can be introduced, as discussed above. For gravel packing the annuluses 48*b*, 48*d*, and 48*e*, the slurry referred to above can include a conventional permeable particulate material, such as gravel, sand, proppant, resin-coated proppant, permeable cement, open cell foam, beads of polymers, metals, ceramics, and similar materials. Also, it is possible to perform conventional hydraulic fracturing through the annuluses 48*b*, 48*d*, and 48*e* to extend their conductive paths by discharging proppant through the annuluses and into the respective production intervals of the formation 14.

Moreover, other conventional gravel packing techniques remain available for placing the slurry's particulate material in the annuluses 48*b*, 48*d*, and 48*e*. For example, in addition to gravel packing the annuluses 48*b*, 48*d*, and 48*e* as described above, a sand control screen can be installed, and the slurry's particulate material can be placed around the screen. Expandable screens can also be installed inside the casing and expanded against the perforated casing after the placement of permeable particulate material described above in the annuluses 48*b*, 48*d*, and 48*e*.

It is also understood that the drawings and their various components shown and discussed above are not necessarily drawn to scale. Further, it can be appreciated that the production and non-production intervals of the formation 14 are not necessarily located in alternating areas of the formation, in which case the perforations formed through the casing 34 will be changed accordingly. Still further, although FIG. 1 shows a vertical well and an offshore environment, the techniques of the illustrative embodiments are equally well-suited for application in deviated wells, inclined wells, horizontal wells, and/or onshore environments. Also, the shroud 114, rather than being formed integrally with the casing section 34*b*, can be separately formed and then connected to the casing section 34*b*. Moreover, the casing sections 34*b*, 34*d* and 34*e* can be inserted into the wellbore 32 in a non-perforated condition and then a conventional perforating gun can be inserted into the casing to fire charges for perforating the casing sections. It is also understood that spatial references, such as "upper," "lower," "outer," "inner," "over," "between," "radially" and "axially," are for the purpose of illustration only and do not limit the specific orientation or location of the structure described above.

Although only a few exemplary embodiments of these inventions have been described in detail above, those skilled in the art will readily appreciate that many other modifications are possible in the exemplary embodiments without materially departing from the novel teachings and advantages of these inventions. Accordingly, all such modifications are intended to be included within the scope of these inventions as defined in the following claims. In the claims, means-plus-function clauses are intended to cover the structures described herein as performing the recited function and not only structural equivalents, but also equivalent structures.

What is claimed is:

1. Apparatus for transferring material in a wellbore in an earth formation, comprising:

a pipe insertable into the wellbore; and a conduit fixed to the pipe, insertable alongside the pipe into the wellbore, and having a first section with a perforated wall for location adjacent a non-production interval of the formation, and having a second section with an unperforated wall for location adjacent a production interval of the formation, such that the material is injectable into the conduit and out the perforated wall of the first section of the conduit.

2. The apparatus of claim 1 wherein the material is injectable into the conduit from the pipe.

3. The apparatus of claim 2 wherein the material is injectable into the conduit from the pipe by connecting an end of the conduit to a first end of the pipe, inserting the material into a second end of the pipe, inserting a plug into the second end of the pipe, and pushing the plug through the pipe to force the inserted material out the first end of the pipe into the conduit.

4. The apparatus of claim 2 wherein the pipe has perforations that are openable after the material is injected into the conduit from the pipe.

5. The apparatus of claim 4 wherein the perforations are openable by inserting a perforating gun into the pipe and firing a charge from the perforating gun.

6. The apparatus of claim 4 wherein the perforations are openable by removing a removable sealant from the perforations.

7. The apparatus of claim 6 wherein the removable sealant is removable from the perforations by applying heat to the pipe.

8. The apparatus of claim 6 wherein the removable sealant is removable from the perforations by applying frequency waves to the pipe.

9. The apparatus of claim 6 wherein the removable sealant is removable from the perforations by injecting a dissolving fluid into the pipe.

10. The apparatus of claim 1 wherein the conduit is fixed to the pipe by being integral with the pipe.

11. The apparatus of claim 1 wherein the conduit is fixed to the pipe by being connected to an outer wall of the pipe.

12. The apparatus of claim 1 further comprising:

a device insertable into the wellbore between the first and second sections of the conduit, such that the material is injectable into the conduit and out the perforated wall of the first section of the conduit to substantially fill a first region between the wellbore and the first section of the conduit, while the device substantially isolates the material from reaching a second region between the wellbore and the second section of the conduit.

13. The apparatus of claim 12 wherein the device includes a packer.

14. The apparatus of claim 12 wherein the device includes a centralizer.

15. The apparatus of claim 12 wherein the first section of the conduit is aligned with a first section of the pipe, and the second section of the conduit is aligned with a second section of the pipe.

16. The apparatus of claim 15 wherein the material is a first material, and the second section of the pipe has perforations, such that a second material is injectable into the pipe and out the perforations to substantially fill the second region, while the device substantially isolates the second material from reaching the first region.

17. The apparatus of claim 16 wherein the second material is a permeable material.

18. The apparatus of claim 15, wherein the production interval is a first production interval of the formation, and wherein:

the first section of the pipe is interposed between the second section and a third section of the pipe; and the first section of the conduit is interposed between the second section and a third section of the conduit, the third section of the conduit having an unperforated wall for location adjacent a second production interval of the formation.

19. The apparatus of claim 18 wherein the device is a first device, the material is a first material, and the second and third sections of the pipe have perforations, and comprising:

a second device insertable into the wellbore between the first and third sections of the conduit, such that:

the first material is injectable into the conduit and out the perforated wall of the first section of the conduit to substantially fill the first region, while the second device substantially isolates the first material from reaching a third region between the wellbore and the third section of the conduit; and a second material is injectable into the pipe and out the perforations to substantially fill the second and third regions, while the first and second devices substantially isolate the second material from reaching the first region.

20. The apparatus of claim 1 wherein the material is cement.

21. The apparatus of claim 1 wherein the material is a conformance agent.

22. Apparatus for transferring material in a wellbore in an earth formation, comprising:

a pipe insertable into the wellbore;

a conduit fixed to the pipe, insertable alongside the pipe into the wellbore, and having a first section with a perforated wall for location adjacent a non-production interval of the formation, and having a second section with an unperforated wall for location adjacent a production interval of the formation, the first section of the conduit being aligned with a first section of the pipe, and the second section of the conduit being aligned with a second section of the pipe; and a device insertable into the wellbore between the first and second sections of the conduit, such that the cement is injectable into the conduit and out the perforated wall of the first section of the conduit to substantially fill a first region between the wellbore and the first section of the conduit, while the device substantially isolates the cement from reaching a second region between the wellbore and the second section of the conduit.

23. The apparatus of claim 22 wherein the cement is injectable into the conduit from the pipe.

24. The apparatus of claim 23 wherein the material is injectable into the conduit from the pipe by connecting an end of the conduit to a first end of the pipe, inserting the material into a second end of the pipe, inserting a plug into the second end of the pipe, and pushing the plug through the pipe to force the inserted material out the first end of the pipe into the conduit.

25. The apparatus of claim 23 wherein the second section of the pipe has perforations that are openable after the material is injected into the conduit from the pipe.

26. The apparatus of claim 25 wherein the perforations are openable by inserting a perforating gun into the pipe and firing a charge from the perforating gun.

27. The apparatus of claim 25 wherein the perforations are openable by removing a removable sealant from the perforations.

28. The apparatus of claim 22 wherein the conduit is fixed to the pipe by being integral with the pipe.

29. The apparatus of claim 22 wherein the conduit is fixed to the pipe by being connected to an outer wall of the pipe.

30. The apparatus of claim 22 wherein the device includes a packer.

31. The apparatus of claim 22 wherein the device includes a centralizer.

32. The apparatus of claim 22 wherein the second section of the pipe has perforations, such that a permeable material is injectable into the pipe and out the perforations to substantially fill the second region, while the device substantially isolates the permeable material from reaching the first region.

33. The apparatus of claim 22, wherein the production interval is a first production interval of the formation, and wherein:

the first section of the pipe is interposed between the second section and a third section of the pipe; and the first section of the conduit is interposed between the second section and a third section of the conduit, the third section of the conduit having an unperforated wall for location adjacent a second production interval of the formation.

34. The apparatus of claim 33 wherein the device is a first device, and the second and third sections of the pipe have perforations, and comprising:

a second device insertable into the wellbore between the first and third sections of the conduit, such that:

the cement is injectable into the conduit and out the perforated wall of the first section of the conduit to substantially fill the first region, while the second device substantially isolates the cement from reaching a third region between the wellbore and the third section of the conduit; and a permeable material is injectable into the pipe and out the perforations to substantially fill the second and third regions, while the first and second devices substantially isolate the permeable material from reaching the first region.

35. A method of transferring material in a wellbore in an earth formation, the method comprising:

inserting a pipe into the wellbore;

inserting a conduit alongside the pipe into the wellbore, the conduit being fixed to the pipe and having a first section with a perforated wall located adjacent a non-production interval of the formation, and having a second section with an unperforated wall located adjacent a production interval of the formation; and injecting the material into the conduit and out the perforated wall of the first section of the conduit.

36. The method of claim 35 wherein the injecting comprises:

from the pipe, injecting the material into the conduit.

37. The method of claim 36 wherein the injecting comprises:

connecting an end of the conduit to a first end of the pipe;

inserting the material into a second end of the pipe;

inserting a plug into the second end of the pipe; and pushing the plug through the pipe to force the inserted material out the first end of the pipe into the conduit.

38. The method of claim 36 and comprising:

after the material is injected into the conduit from the pipe, opening perforations in the pipe.

39. The method of claim 38 wherein the opening comprises:

opening the perforations by inserting a perforating gun into the pipe and firing a charge from the perforating gun.

40. The method of claim 38 wherein the opening comprises:

opening the perforations by removing a removable sealant from the perforations.

41. The method of claim 35 and comprising:

inserting a device into the wellbore between the first and second sections of the conduit, such that the injected material substantially fills a first region between the wellbore and the first section of the conduit, while the device substantially isolates the material from reaching a second region between the wellbore and the second section of the conduit.

42. The method of claim 41, and comprising:

aligning the first section of the conduit with a first section of the pipe; and aligning the second section of the conduit with a second section of the pipe.

43. The method of claim 42 wherein the material is a first material, and the second section of the pipe has perforations, and comprising:

injecting a second material into the pipe and out the perforations to substantially fill the second region, while the device substantially isolates the second material from reaching the first region.

44. The method of claim 43 wherein the second material is a permeable material.

45. The method of claim 42, wherein the production interval is a first production interval of the formation, and comprising:

interposing the first section of the pipe between the second section and a third section of the pipe; and interposing the first section of the conduit between the second section and a third section of the conduit, the third section of the conduit having an unperforated wall located adjacent a second production interval of the formation.

46. The method of claim 45 wherein the device is a first device, and comprising:

inserting a second device into the wellbore between the first and third sections of the conduit, such that:

the injected first material substantially fills the first region, while the second device substantially isolates the first material from reaching a third region between the wellbore and the third section of the conduit.

47. The method of claim 46 wherein the material is a first material, and the second and third sections of the pipe have perforations, and comprising:

injecting a second material into the pipe and out the perforations to substantially fill the second and third regions, while the first and second devices substantially isolate the second material from reaching the first region.

48. The method of claim 35 wherein the material is cement.

49. The method of claim 35 wherein the material is a conformance agent.

50. A method for transferring material into an annulus defined between a wellbore and a casing in a ground formation, the method comprising: introducing a first flowable material into the casing, directing the first material from the casing into a conduit, directing the first material from the conduit into a first area of the annulus, and directing a second material from the casing directly into a second area of the annulus, wherein the first area of the annulus is locate adjacent a non-production interval of the formation, and wherein the second area of the annulus is located adjacent a production interval of the formation.

51. The method of claim 50 wherein the first material is a cement, and wherein the second material is a granular packing material.

52. Apparatus for transferring material in a wellbore comprising at least one casing section disposed in the wellbore to define an annulus between the wellbore and the casing section, the casing section having a blocked opening formed therethrough, at least one conduit disposed adjacent the casing section and in flow communication with the casing section, means for introducing a first flowable material into the casing section with the opening blocked to direct the material to the conduit, and means for introducing a second flowable material into the casing section with the opening unblocked to direct the material directly into the annulus, wherein at least one performation is formed through the conduit to direct the first material into the annulus, wherein the wellbore is located in a ground formation, wherein the opening in the casing section is adjacent a production interval of the formation, and wherein the perforation in the conduit is adjacent a non-production interval of the formation.

53. The apparatus of claim 52 wherein the conduit is for directing the first material into the annulus.

54. The apparatus of claim 52 wherein the opening in the casing section and the perforation in the conduit are at different locations in the wellbore.

55. The method of claim 52 wherein the first material is a cement, and wherein the second material is a granular packing material.

* * * * *